US006860528B2

(12) United States Patent
O'Brien, II

(10) Patent No.: US 6,860,528 B2
(45) Date of Patent: Mar. 1, 2005

(54) EXIT DEVICE WITH A DETACHABLE TOUCH BAR ASSEMBLY

(75) Inventor: James A. O'Brien, II, LaSalle, MI (US)

(73) Assignee: Ervos, Inc., Pittsburgh, PA (US)

( * ) Notice: Subject to any disclaimer, the term of this patent is extended or adjusted under 35 U.S.C. 154(b) by 0 days.

(21) Appl. No.: 10/127,784

(22) Filed: Apr. 22, 2002

(65) Prior Publication Data

US 2002/0153731 A1 Oct. 24, 2002

Related U.S. Application Data

(60) Provisional application No. 60/286,149, filed on Apr. 24, 2001.

(51) Int. Cl.[7] ..... E05B 65/10

(52) U.S. Cl. ..... 292/92; 292/21; 292/93; 292/DIG. 53; 292/DIG. 64; 292/DIG. 65; 70/92

(58) Field of Search ..... 242/92, 21, 93, 242/DIG. 53, DIG. 64, DIG. 65; 70/92

(56) References Cited

U.S. PATENT DOCUMENTS 927,654 A * 7/1909 Hood ..... 292/92
943,973 A * 12/1909 Hope et al. ..... 292/92
975,456 A * 11/1910 Prevost ..... 292/93
2,087,165 A * 7/1937 Ruth ..... 292/92
2,752,773 A * 7/1956 Abelson et al. ..... 70/92
3,076,328 A * 2/1963 Rhodes et al. ..... 70/92
3,097,007 A * 7/1963 Eichaker et al. ..... 292/92
4,083,590 A * 4/1978 Folger ..... 292/92
4,181,335 A * 1/1980 Thoren ..... 292/92
4,295,673 A * 10/1981 Miller ..... 292/21
4,384,738 A * 5/1983 Floyd ..... 292/92
4,601,499 A * 7/1986 Kim ..... 292/36
4,927,193 A * 5/1990 Miller ..... 292/92
4,961,330 A * 10/1990 Evans ..... 292/21
5,042,851 A * 8/1991 Hunt ..... 292/21
5,054,825 A * 10/1991 Mangin et al. ..... 292/92
5,169,185 A * 12/1992 Slaybaugh et al. ..... 292/92
5,322,332 A * 6/1994 Toledo et al. ..... 292/92
5,947,534 A * 9/1999 Zarzycki ..... 292/92
6,000,733 A * 12/1999 Linder ..... 292/92
6,032,985 A * 3/2000 Cutter ..... 292/92
6,205,825 B1 * 3/2001 Haeck et al. ..... 70/92
6,409,232 B1 * 6/2002 Nigro et al. ..... 292/92

* cited by examiner

*Primary Examiner*—Daniel P. Stodola
*Assistant Examiner*—Carlos Lugo
(74) *Attorney, Agent, or Firm*—Paul A. Beck & Associates, P.C.

(57) ABSTRACT

This is invention provides a touch bar exit device for a door having an active case attached to the door and an inactive case attached to the door. A touch bar assembly is releasable attached to the active case and the inactive case.

5 Claims, 7 Drawing Sheets

EXIT DEVICE WITH A DETACHABLE TOUCH BAR ASSEMBLY

CROSS-REFERENCE TO RELATED APPLICATION

This application claims the benefit of U.S. Provisional Application No. 60/286,149 filed on Apr. 24, 2001.

BACKGROUND OF THE INVENTION

1. Field of the Invention

This invention relates to a touch bar exit device where the touch bar assembly can be readily attached or detached from an active case and an inactive case.

2. Description of Related Art

Existing touch bar exit devices have the following components that are connected to one another: (i) active case; (ii) inactive case; and (iii) touch bar assembly. Existing touch bar exit devices are installed on a door as a one piece unit.

This arrangement presents difficulties when one person attempts to install the touch bar exit device. The installer must balance the entire exit device while he uses two hands to first install an outside door handle to the inside active case. Two people can do the job but for cost reasons one person ends up doing the job.

To our knowledge no prior art exists where the exit device is not installed as a one piece unit.

SUMMARY OF THE INVENTION

The present inventions involves an exit device that has a touch bar assembly which is easily attachable to or detachable from a fixed active case and a fixed inactive case located at either side of the door.

This is invention provides a touch bar exit device for a door having an active case attached to the door and an inactive case attached to the door. A touch bar assembly is releasable attached to the active case and the inactive case.

This invention provides a touch bar exit device for a door having an active case attached to the door. A captivator at an end of the active case has a channel zone. The active case has a spring loaded lock activator that is slidably mounted and urged toward the captivator. A touch bar assembly having a sliding activator plate which engages the lock activator. A retention structure is mounted at one end of the touch bar assembly. The retention structure is inserted in the channel zone of the captivator whereby the touch bar assembly is locked in place with the active case cover and in a normally horizontal plane to enable the sliding activator plate to engage the lock activator.

This invention provides a method for installing a touch bar exit device to a door wherein the active case is attached to the door. One end of the touch bar assembly is attached to the active case and an opposite end of the touch bar assembly is attached to the inactive case. The touch bar assembly can have an inactive case attached to it when it is attached to the active case.

This is invention provides a touch bar exit device for a door having an active case attached to the door and an inactive case attached to the door. A touch bar assembly is releasably attached to the active case and the inactive case.

DETAILED DESCRIPTION OF THE INVENTION

Definitions

Figure 1:
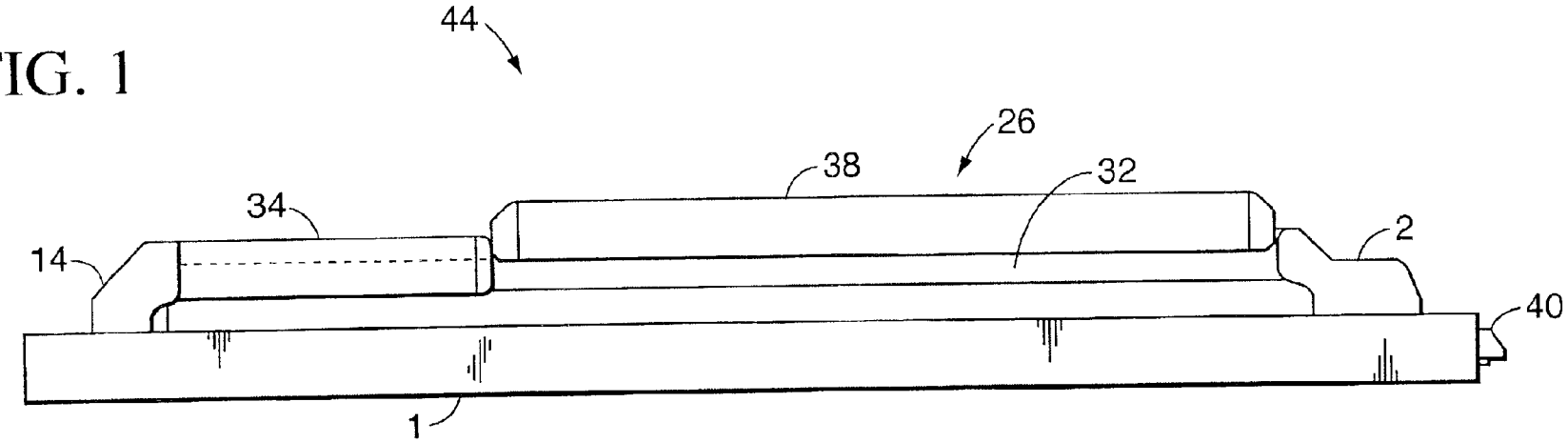
FIG. 1 A side view of complete touch bar exit device on a door.

"Touch Bar Exit Device" means a locking mechanism that includes a touch bar assembly on the push side of an exit door; interlinked with a latching mechanism that interfaces with a strike (or "keeper") mounted on the door frame. Pushing the touch bar always retracts the latchbolt allowing the door to open. The activating touch bar must span half the width of the door, from latch side to middle.

"Active Case" means a configured base of an active case affixed to a latching side of door by means of thru-bolts which fasten through the door to outside trim. Mechanics of the base interface with a latching assembly. The active case also receives one end of a touch bar channel. The active case includes an active case chassis and an active case cover.

"Captivator" means two wing like projections located at a back of an active case chassis. Each has an open-ended slot, e.g. channel zone, to receive a pin like retention structure at a front end of a touch bar channel.

"Lock Activator" means a spring loaded projecting stud at a back of an active case chassis that interacts with a forward thrusting activator plate at a front end of a touch bar channel. The lock activator moves a mechanism for retracting a latchbolt.

"Inactive Case" means a configured mounting plate that can be affixed to a hinge side of a door. It is the means for holding a back end of the touch bar channel to the door. The inactive case includes a chassis and a cover.

"Draw Bar" means a configured metal piece that provides the means for placing a touch bar assembly into tension. Its uppermost part fits against the upper inside surface of a filler plate tube; its slot engages a protrusion at a base of a touch bar channel; and the lower part has two oval holes for attaching to a door through an inactive case base chassis.

"Touch Bar Assembly" includes a touch bar channel, a spring loaded touch bar which is connected to a touch bar channel by pivot mechanism at both ends of the touch bar, and a filler plate tube located behind the touch bar towards the hinge side of the door. The entire assembly is detachable from an active case and an inactive case.

"Retention Structure" means a pin like structure at a front end of a touch bar channel. It is inserted into a channel zone of a captivator, thus positioning a touch bar assembly with an active case chassis so that an activator plate properly engages a lock activator.

"Activator Plate" means a spring loaded configurated plate that thrusts forward when a touch bar is depressed. The activator plate engages a lock activator which, in turn, moves a mechanism for retracting a latchbolt.

"Dimple" means a stamped protrusion along a bottom (web) of a touch bar channel located towards an inactive case. The dimple projections insert into a draw bar slot of a draw bar.

"Filler Plate Tube" means a rectangular tube at a back end of a touch bar assembly that contains and attaches to the back of the touch bar channel near an inactive case.

"Touch Bar" means a spring loaded activator bar on a push side of a door that activates a locking mechanism for retracting a latchbolt. It is attached at each end by pivot arms to a touch bar channel.

"Latchbolt" means beveled bolt that projects into a strike (keeper) mounted on a door frame, thus securing the door to the frame. A spring loaded latchbolt is retracted by a touch bar.

"Attached to the door" means that the exit device is fastened to the door itself or thru-bolted through the door to the outside handle trim or thru-bolted so that the head of the bolt is affixed to or acts against the outer side of the door.

"Releasably attached" means the touch bar assembly can be attached or detached to the active and inactive cases which are affixed to a door.

"Channel Zone" means open-ended slots at the ends of the captivator which are intended to receive the retention structure.

"Slidably Mounted" means moving the touch bar assembly horizontally along the plane of the door so that the retention structure, at end to touchbar channel, engages in the channel zone of the captivator, which is located at the back end of the active case chassis.

"Urged toward the captivator" means a mechanical process where depressing the touch bar moves the activator plate against the lock activator which is between the two wings of the captivator.

"End of the Touch Bar Assembly" means part of the touch bar assembly that engages the inactive case.

"Locked into Place" means when the retention structure at the forward end of the touch bar channel is full, mounted in the channel zone of the captivator and the active case cover caps the entire active case chassis and locks the engaging mechanisms into place.

"Attaching" means mechanically fastening with screws or bolts.

Description

FIG. 1 illustrates the entire touch bar exit device 44 on a door 1. The exit device includes a touch bar assembly 26, an active case 2, and an inactive case 14. The touch bar assembly 26 includes a supporting touch bar channel 32 that connects to both the active case 2 and the inactive case 14, a touch bar 38 that retracts a latchbolt 40 when depressed, and a filler plate tube 34 which covers and is attached to the touch bar channel 32.

Figure 2:
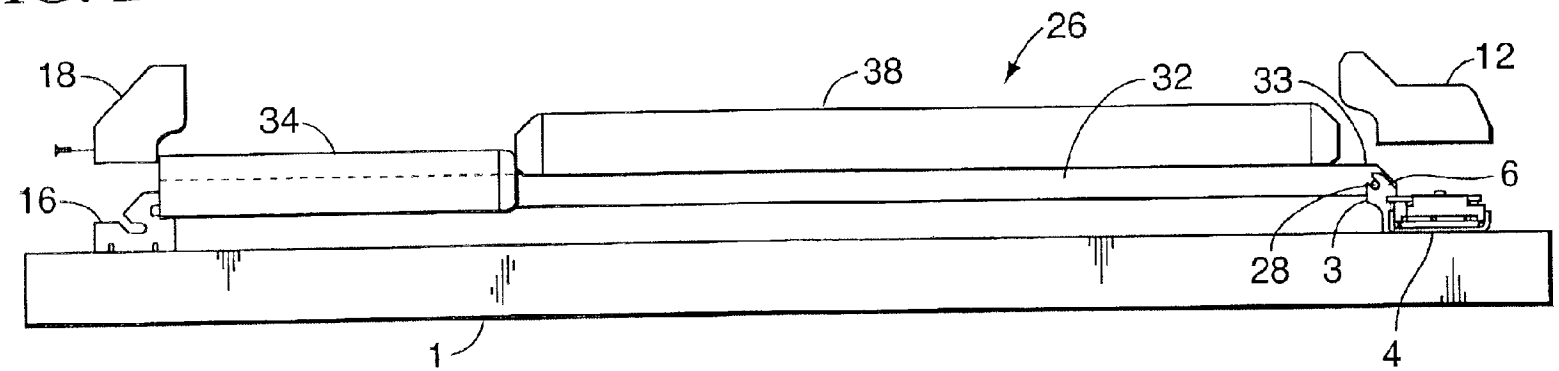
FIG. 2 A side view of a touch bar exit device with both an active case cover and an inactive case cover removed.

FIG. 2 shows that a front end 33 of the touch bar channel 32 with a retention structure 28 being held by a captivator 6 at a back 3 of the active case chassis 4. An active case cover 12 is removed from an active case chassis 4. An inactive case cover 18 is removed form an inactive case chassis 16. The filler plate tube 34 covers and is attached to the touch bar channel 32 that engages the inactive chassis 16.

Figure 3:
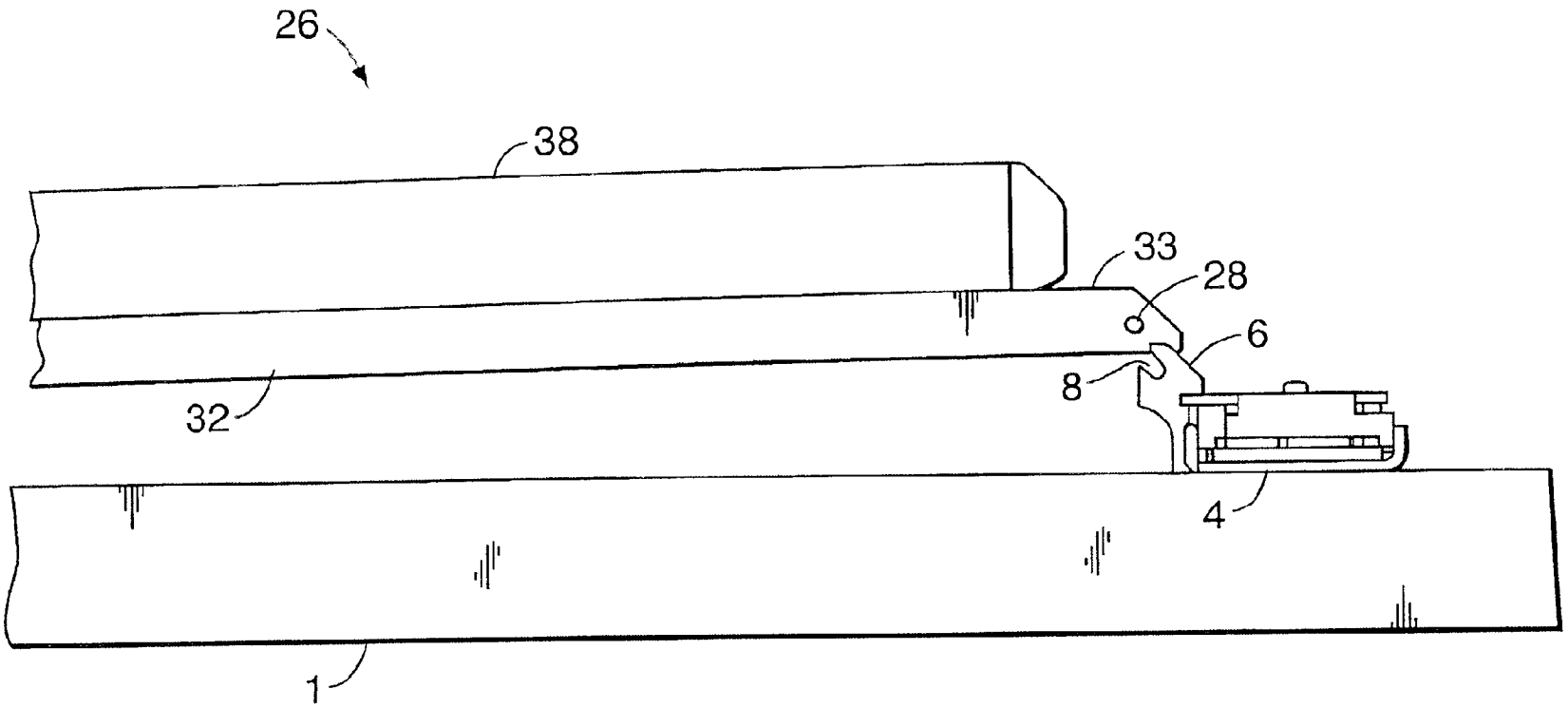
FIG. 3 A side view of a retention structure removed from a channel zone of a captivator.

FIG. 3 shows the front part of the touch bar assembly 26 being disengaged from the active case chassis 4. The retention structure 28 at the front end 33 of the touch bar channel 32 is removed from a channel zone 8 of the captivator 6.

Figure 4:
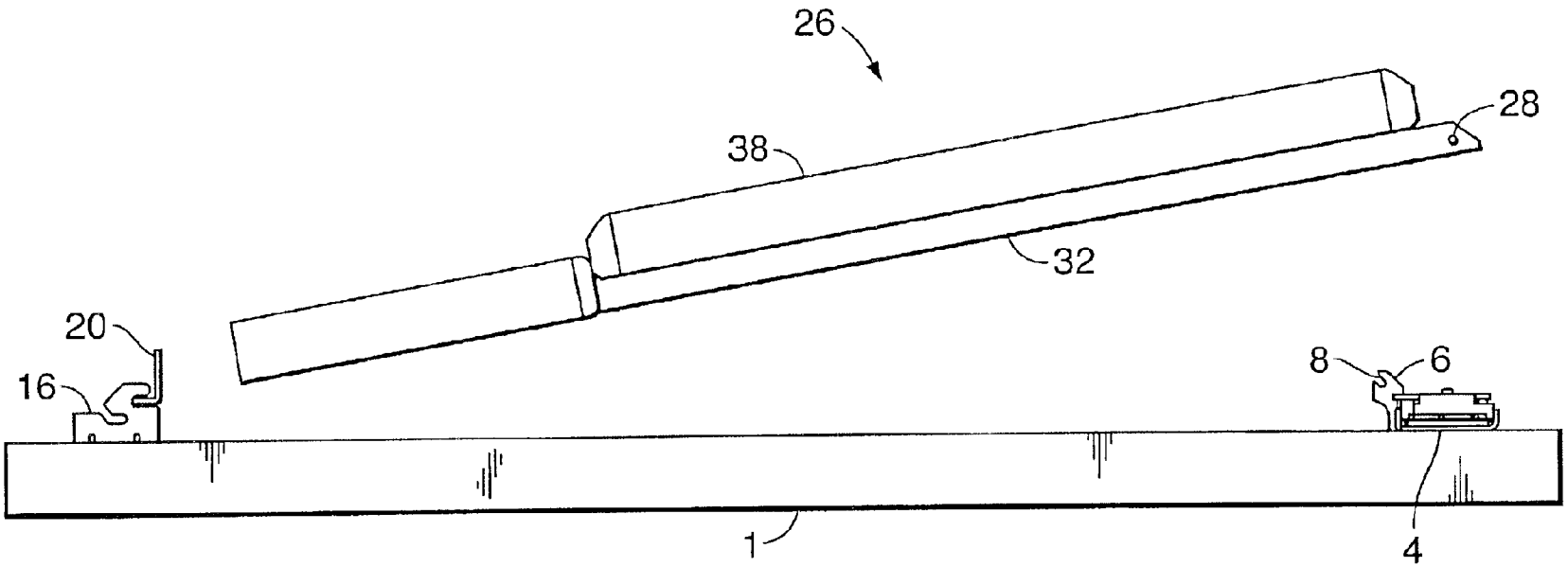
FIG. 4 A side view of the touch bar assembly removed from an inactive case chassis and removed from an active case chassis.

FIG. 4 shows the touch bar assembly 26 being disengaged from both the active chassis 4 and the inactive case chassis 16. Removing the touch bar assembly 26 from the active case chassis involves removing the active case cover 12 (shown in FIG. 2) and pivoting the touch bar assembly 26 away from the active case chassis 4 to remove the retention structure 28 from the channel zone 8 of the captivator 6. The other end of the touch bar assembly 26 is released from a draw bar 20, which is attached to the door 1 through the inactive case chassis 16, when the touch bar assembly 26 is pivoted. This also shows how the touch bar assembly 26 could be installed on the door 1. The inactive case chassis 16 and the active case chassis 4 can be attached to the door 1. The touch bar assembly 26 can then be attached to the inactive case by the draw bar 20. The touch bar assembly 26 is then pivoted to place the retention structure 28 into the channel zone 8 of the captivator 6. The inactive case cover 18 (shown in FIG. 2) would be attached to the inactive case chassis 16. The active case cover 12 (shown in FIG. 2) would be attached to the active case chassis 4. Alternatively and not shown, the touch bar assembly 26 could be attached to the active case chassis 4 having the inactive case 14 already attached to the touch bar assembly 26 and not yet attached to the door 1.

Figure 5:
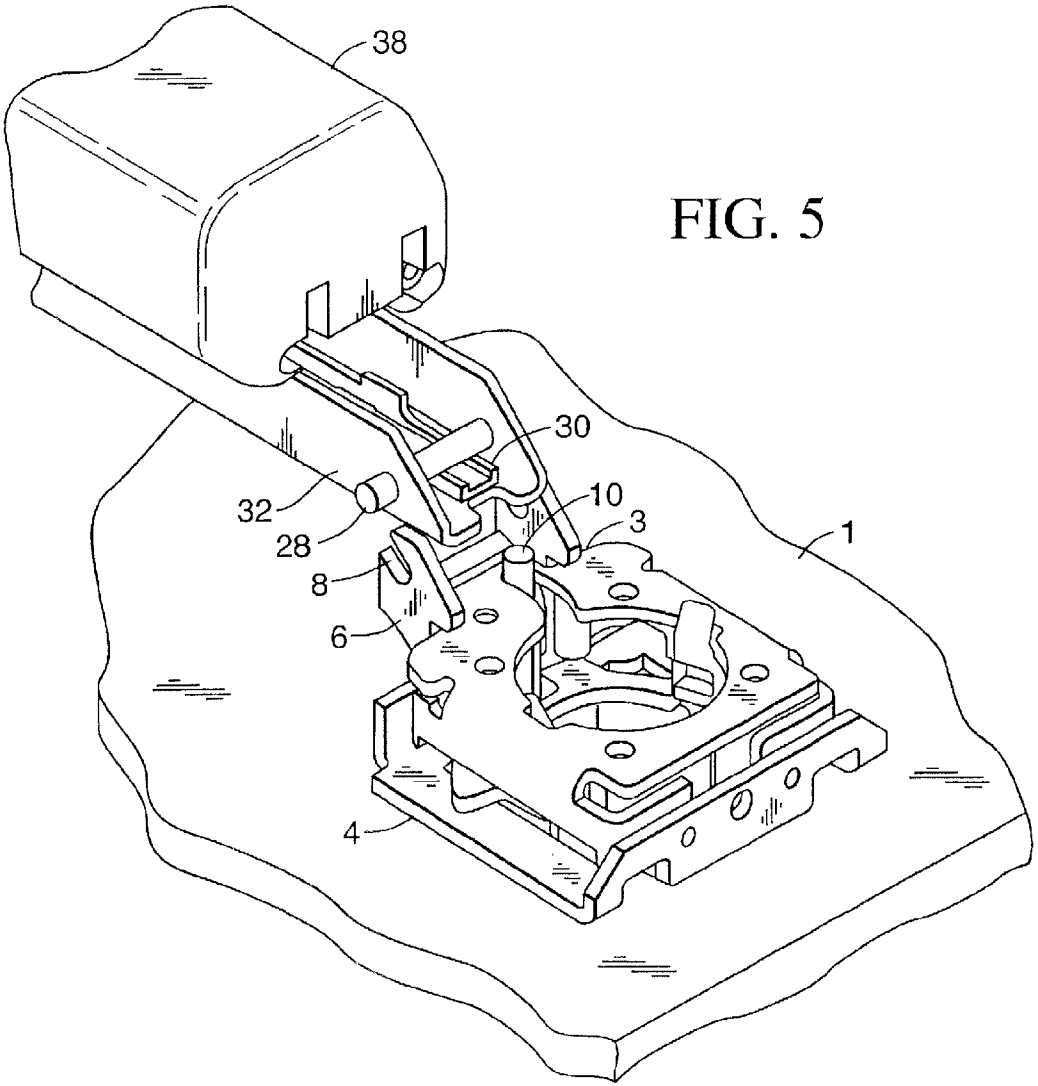
FIG. 5 An isometric view of a retention structure on a touch bar channel detached from a channel zone of a captivator.

FIG. 5 shows the engagement method of the retention structure 28 and the open ended channel zone 8 of the captivator 6 before the retention structure 28 enters into the channel zone 8. The active case chassis 4 has a lock activator 10 which is urged toward the back 3 of the active case chassis 4. Below the retention structure 28 and in the touch bar channel 32 there is a lock activator plate 30.

Figure 6:
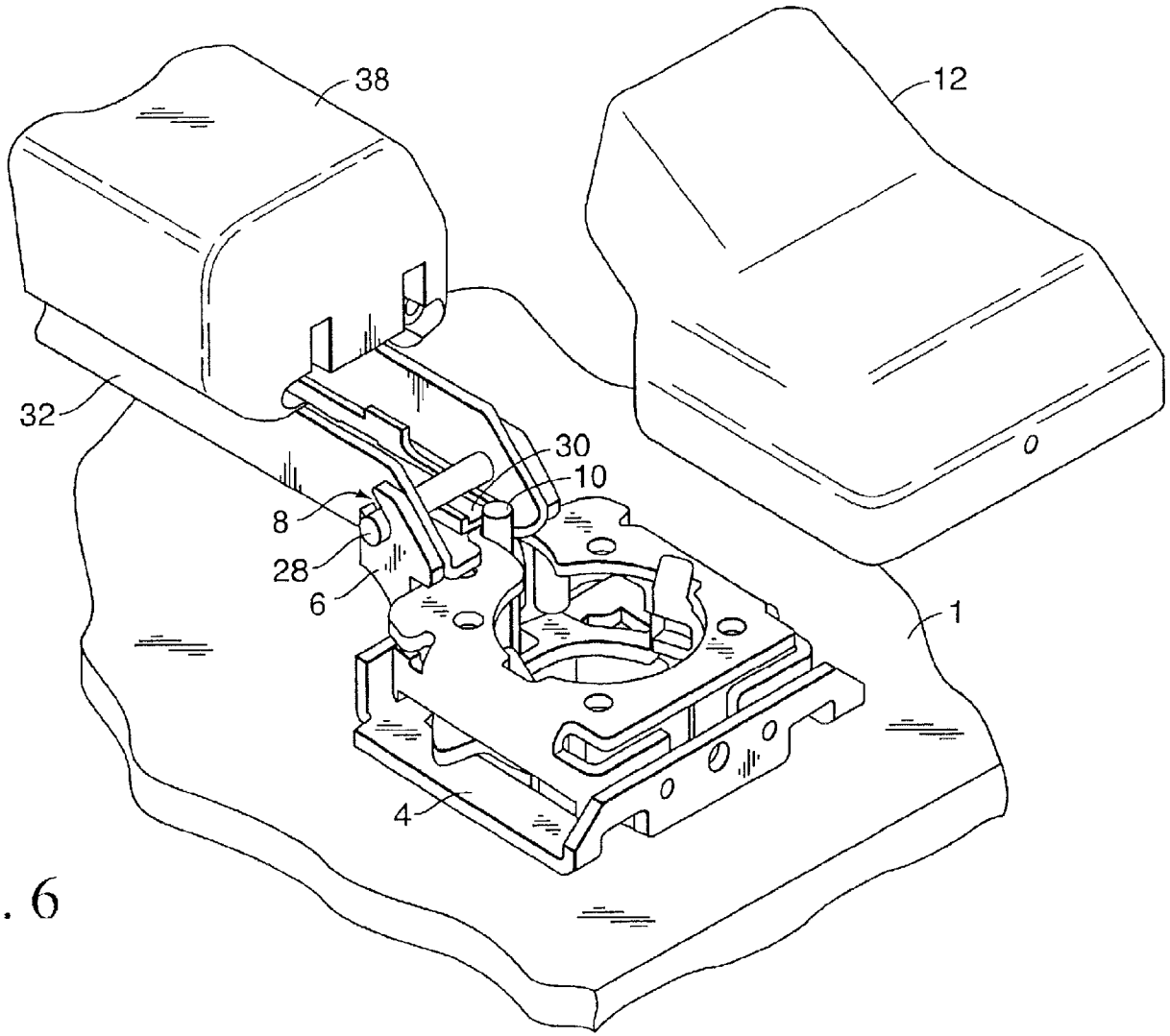
FIG. 6 An isometric view of a retention structure on a touch bar channel interlocking into a channel zone of a captivator.

FIG. 6 shows the retention structure 28 (which can be a heavy duty pin as shown) seated in the channel zone 8 of the captivator 6. The activator plate 30 abuts the lock activator 10. All parts are locked in by capping them with an active case cover 12. Screws (not shown) then fasten the active case cover 12 to the active case chassis 4. When the touch bar 38 is depressed the activator plate 30 engages the lock activator 10 which operates the latchbolt 40 (shown in FIG. 1) and allows the door 1 to be opened.

Figure 7:
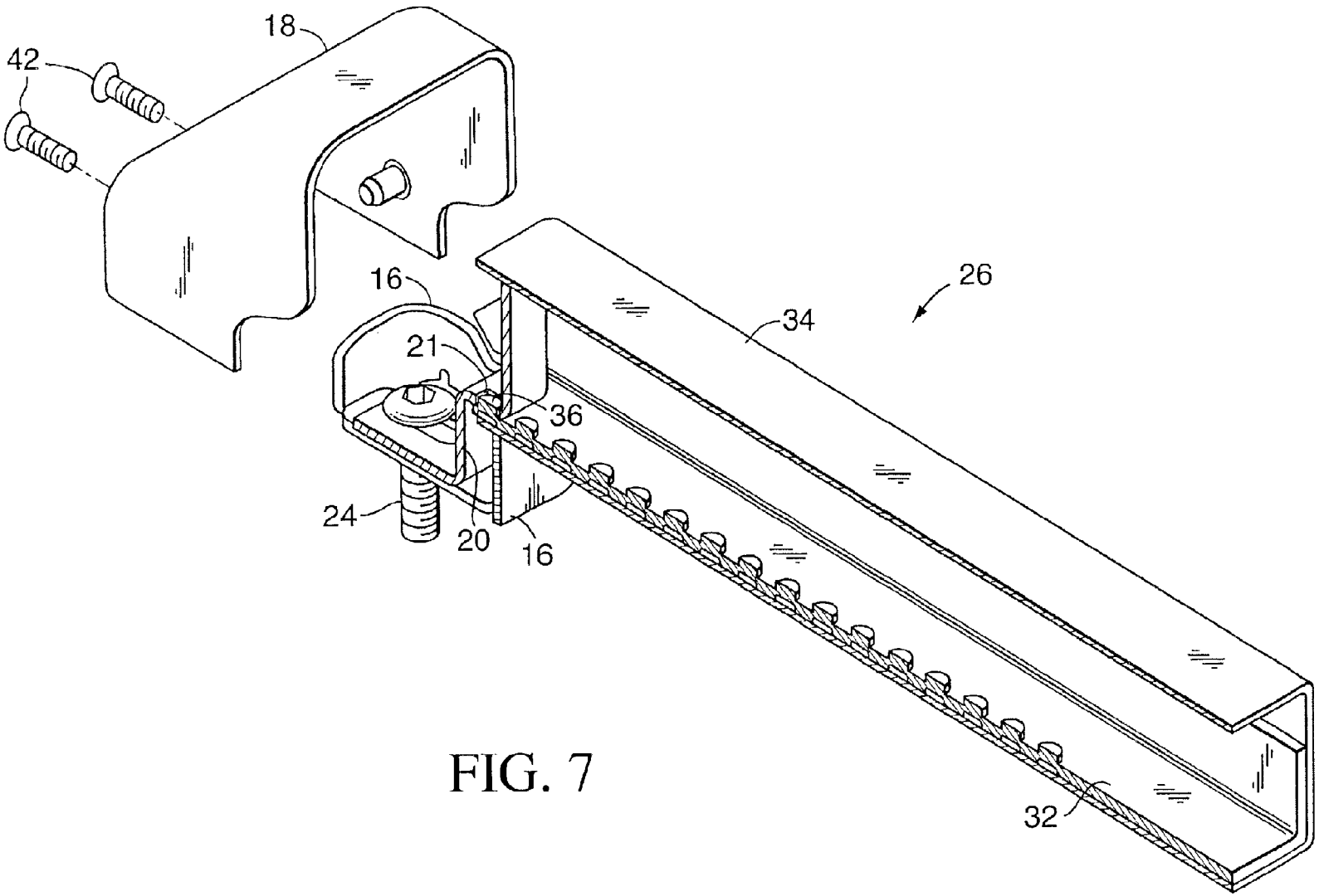
FIG. 7 An isometric view in partial section of an inactive case with an inactive case cover separated from an inactive case chassis and a touch bar channel showing a draw bar positioned with a dimple and a fastener.
Figure 8:
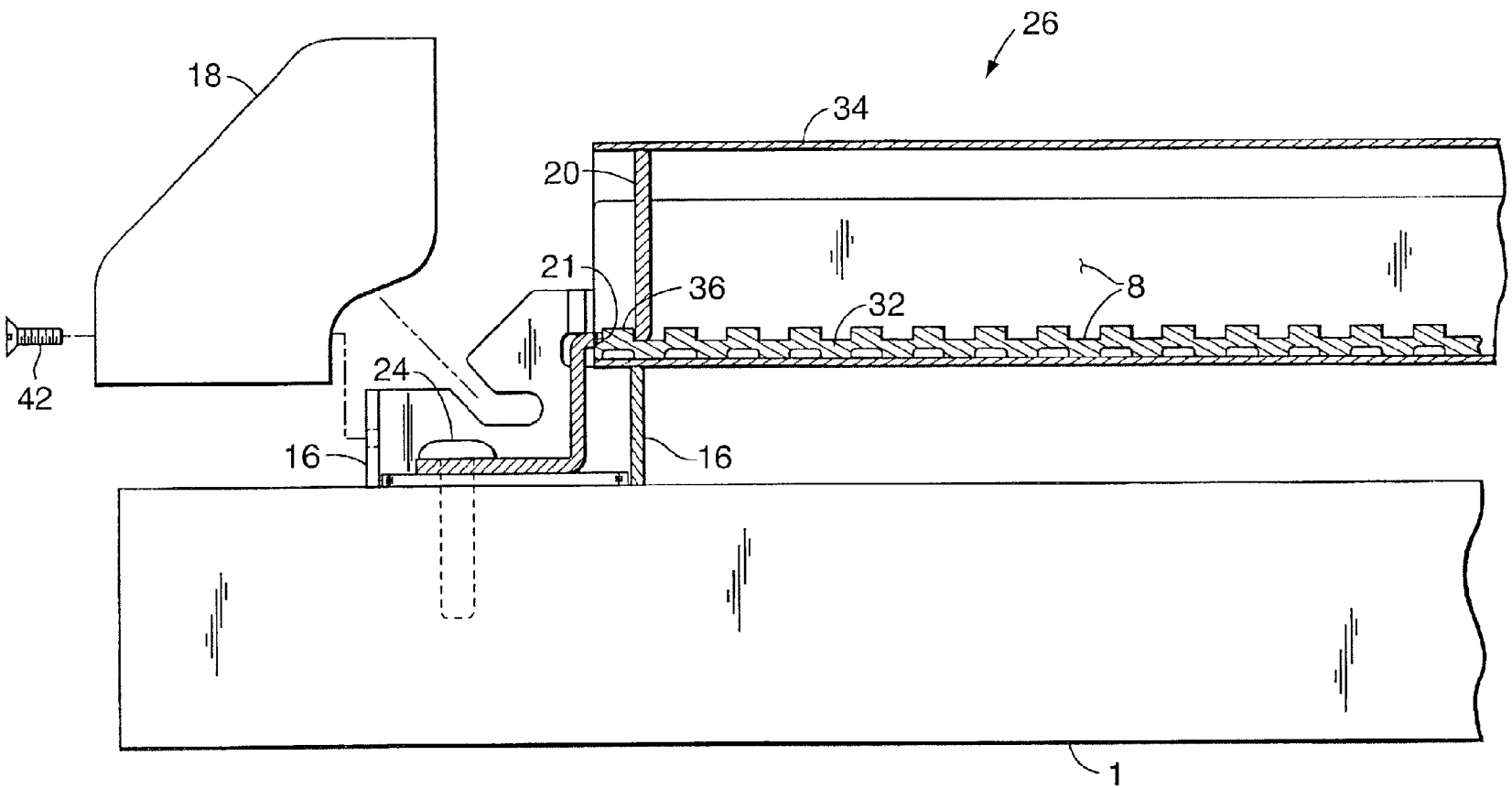
FIG. 8 A side view in partial section of an inactive case cover separated from an inactive case base.

FIGS. 7 and 8 illustrate attaching or detaching the back of the touch bar assembly 26 to the inactive case chassis 16. A dimple 36 at the base of the touch bar channel 32 is inserted into a slot 21 of the draw bar 20. The draw bar 20 is attached to the door 1 through the inactive case chassis 16 by a fastener 24. The slot 21 of the draw bar 20 fastens the touch bar channel 32 and the filler plate tube 34 to the inactive vase chassis 16. Once the dimple 36 is in place the inactive case cover 18 is attached to the inactive case chassis. Screws 42 are used to attach the inactive case cover 18 to the inactive case chassis 16. In order to detach the touch bar assembly 26 from the inactive vase chassis 16 the forward part of the touch bar assembly 26 is released and pivoted outward away from the door 1 (front part not shown in FIGS. 7 and 8) so that the touch bar assembly 26 releases from the draw bar slot 21.

I claim:

1. A touch bar exit device for a door comprising:

(a) an active case attached to the door, the active case includes a latching mechanism (b) a captivator at an end of the active case and having a channel zone;

(c) a spring loaded lock activator in the active case;

(d) a touch bar assembly having a sliding activator plate which engages the lock activator, the touch bar assembly is separate from the active case and releasably attached to the active case; and (e) a retention structure mounted at one end of the touch bar assembly; the retention structure inserted in the channel zone of the captivator whereby the touch bar assembly is releasably attached to the active case.

2. A touch bar exit device for a door comprising:

(a) an active case attached to the door, the active case includes a latching mechanism and having a lock activator;

(b) an inactive case attached to the door and separate from the active case, the inactive case has an inactive case chassis that is directly attached to the door and an inactive case cover that attaches to the inactive case chassis to cover the inactive case chassis; and (c) a touch bit assembly, the touch bar assembly is separate from the (d) active case and the inactive case and releasably attached to the active case and to the inactive case whereby the active case and inactive case are joined together through the touch bar assembly that is releasably attached to the active case and to the inactive case.

3. A method for installing a touch bar exit device to a door comprising:

(a) attaching an active case without a touch bar assembly to the door, the active case includes a latching mechanism having a lock activator;

(b) attaching one end of a touch bar assembly to the active case whereby the active case and the touch bar assembly are releasably joined, the touch bar assembly has a touch bat channel and a spring loaded touch bar connected to the touch bar channel; and (c) attaching an opposite end of the touch bar assembly to an inactive case.

4. A method for installing a touch bar exit device to a door comprising:

(a) attaching an active case without a touch bar assembly to the door, the active case includes a latching mechanism having a lock activator; and (b) attaching one end of a touch bar assembly, that has an opposite end attached to an inactive case, to the active case whereby the active case and the touch bar assembly are releasably joined, the touch bar assembly has a touch bar channel and a spring loaded touch bar connected to the touch bar channel.

5. A touch bar exit device for a door comprising:

(a) an active case attached to the door, the active case includes a latching mechanism and having a lock activator;

(b) an inactive case attached to the door and separate from the active case; and (c) a touch bar assembly, the touch bar assembly is separate from the active case and the inactive case and releasably attached to the active case and to the inactive case whereby the active case and inactive case are joined together through the touch bar assembly that is releasably attached to the active case and to the inactive case, the touch bar assembly has a touch bar channel and a spring loaded touch bar connected to the touch bar channel.

* * * * *

UNITED STATES PATENT AND TRADEMARK OFFICE

CERTIFICATE OF CORRECTION

PATENT NO. : 6,860,528 B2
DATED : March 1, 2005
INVENTOR(S) : James A. O'Brien II It is certified that error appears in the above-identified patent and that said Letters Patent is hereby corrected as shown below:

Title page,
Item [73], Assignee, insert -- Obep, Inc. --
Item [57], ABSTRACT,
Line 1, cancel beginning with "This is invention" and insert the following -- This invention --

Column 1,
Line 30, cancel beginning with "present inventions" and insert the following -- present inventions --
Lines 34 and 58, cancel beginning with "This is invention" and insert the following -- This inventions --

Column 2,
Line 16, cancel "fastener." and insert -- fastener; --

Column 3,
Line 64, cancel beginning with "removed form" and insert the following -- remove from --

Column 4,
Lines 52 and 57, cancel beginning with "inactive vase" and insert the following -- inactive case --
Line 65, cancel "mechanism" and insert -- mechanism; --

Column 5,
Line 20, cancel beginning with "a touch bit" and insert the following -- a touch bar --

Signed and Sealed this

Nineteenth Day of July, 2005

JON W. DUDAS
*Director of the United States Patent and Trademark Office*

UNITED STATES PATENT AND TRADEMARK OFFICE

CERTIFICATE OF CORRECTION

PATENT NO. : 6,860,528 B2
DATED : March 1, 2005
INVENTOR(S) : James A. O'Brien, II It is certified that error appears in the above-identified patent and that said Letters Patent is hereby corrected as shown below:

Column 1,
Line 30, delete "present inventions" and insert -- present invention --.
Lines 34 and 58, delete "This is invention" and insert -- This invention --.

Signed and Sealed this

Twenty-first Day of February, 2006

JON W. DUDAS
*Director of the United States Patent and Trademark Office*